US008552958B2

(12) United States Patent
Park et al.

(10) Patent No.: US 8,552,958 B2
(45) Date of Patent: Oct. 8, 2013

(54) METHOD OF DRIVING A GATE LINE, GATE DRIVE CIRCUIT FOR PERFORMING THE METHOD AND DISPLAY APPARATUS HAVING THE GATE DRIVE CIRCUIT

(75) Inventors: Moon-Chul Park, Seoul (KR); Sang-Jae Yeo, Hwaseong-si (KR)

(73) Assignee: Samsung Display Co., Ltd., Yongin (KR)

( * ) Notice: Subject to any disclaimer, the term of this patent is extended or adjusted under 35 U.S.C. 154(b) by 618 days.

(21) Appl. No.: 12/557,008

(22) Filed: Sep. 10, 2009

(65) Prior Publication Data

US 2010/0109996 A1 May 6, 2010

(30) Foreign Application Priority Data

Oct. 30, 2008 (KR) ..... 10-2008-0107115

(51) Int. Cl.
*G09G 3/36* (2006.01)

(52) U.S. Cl.
USPC ..... 345/100

(58) Field of Classification Search
None
See application file for complete search history.

(56) References Cited

U.S. PATENT DOCUMENTS

| | | | | |
|---|---|---|---|---|
| 5,748,169 | A * | 5/1998 | Okumura et al. | 345/100 |
| 6,181,312 | B1 * | 1/2001 | Sekine | 345/98 |
| 2003/0174118 | A1 * | 9/2003 | Sato et al. | 345/100 |
| 2004/0189583 | A1 * | 9/2004 | Park et al. | 345/100 |
| 2005/0200591 | A1 * | 9/2005 | Satoh et al. | 345/103 |
| 2006/0227094 | A1 * | 10/2006 | Park et al. | 345/100 |

FOREIGN PATENT DOCUMENTS

| | | |
|---|---|---|
| JP | 2004-061590 | 2/2004 |
| KR | 1020050103317 | 10/2005 |
| KR | 1020060085374 | 7/2006 |

* cited by examiner

*Primary Examiner* — Christopher R Lamb
(74) *Attorney, Agent, or Firm* — H.C. Park & Associates, PLC

(57) ABSTRACT

There is provided a method of driving a gate line, a gate drive circuit for performing the method, and a display apparatus having the gate drive circuit. In the method, a plurality of gate signals, generated from a plurality of shift registers connected to a plurality of gate lines, is applied to the gate lines. An output of the gate signals is blocked during a vertical blanking interval, and then a gate off voltage is applied to the gate lines. Therefore, an output signal of the gate drive circuit may maintain a gate off voltage during a vertical blanking interval in which a clock signal is not applied to a gate drive circuit.

11 Claims, 7 Drawing Sheets

METHOD OF DRIVING A GATE LINE, GATE DRIVE CIRCUIT FOR PERFORMING THE METHOD AND DISPLAY APPARATUS HAVING THE GATE DRIVE CIRCUIT

CROSS REFERENCE TO RELATED APPLICATION

This application claims priority from and the benefit of Korean Patent Application No. 2008-107115, filed on Oct. 30, 2008, which is hereby incorporated by reference for all purposes as if fully set forth herein.

BACKGROUND OF THE INVENTION

1. Field of the Invention

The present invention relates to a method of driving a gate line, a gate drive circuit for performing the method, and a display apparatus having the gate drive circuit. More particularly, exemplary embodiments of the present invention relate to a method of driving a gate line capable of enhancing driving defects, a gate drive circuit for performing the method, and a display apparatus having the gate drive circuit.

2. Discussion of the Background

Generally, a liquid crystal display (LCD) apparatus includes an LCD panel that displays images using a light-transmitting ratio of liquid crystal molecules, and a backlight assembly disposed below the LCD panel to provide the LCD panel with light.

The LCD apparatus includes a display panel, a gate driving part, and a data driving part. The display panel includes a plurality of gate lines, a plurality of data lines, and a plurality of pixel parts electrically connected to the gate lines and the data lines. The gate driving part outputs a gate signal to the gate lines. The data driving part outputs a data signal to the data lines. The gate driving part and the data driving part may be formed in a chip to be mounted on the display panel.

Recently, in order to decrease a size of the LCD apparatus and enhance its productivity, the gate driving part may be integrated on a display substrate in an amorphous silicon gate (ASG) type. However, when a gate drive circuit integrated on the display substrate is driven at a high temperature, an abnormal gate on signal may be generated during a gate off signal interval.

Moreover, in a vertical blanking interval, a clock signal for a gate drive circuit is not applied to the gate drive circuit, so that an output signal of the gate drive circuit may be floated. When the output signal of the gate drive circuit is floated, an off voltage of a gate electrode may increase due to a parasitic capacitor (Cgd) between the gate line and the data line, which may turn on a pull-up element of the gate drive circuit. Thus, a gate on signal may be intermittently generated during the gate off signal interval, thereby generating display defects.

SUMMARY OF THE INVENTION

Exemplary embodiments of the present invention provide a method of driving a gate line that may prevent driving defects of a display apparatus.

Exemplary embodiments of the present invention also provide a gate drive circuit for performing the above-mentioned method.

Exemplary embodiments of the present invention also provide a display apparatus having the above-mentioned gate drive circuit.

Additional features of the invention will be set forth in the description which follows, and in part will be apparent from the description, or may be learned by practice of the invention.

The present invention discloses a method of driving a gate line. In the method, a plurality of gate signals, which are generated from a plurality of shift registers connected to a plurality of gate lines, is applied to the gate lines. An output of the gate signals is blocked during a vertical blanking interval, and then a gate off voltage is applied to the gate lines during the vertical blanking interval.

The present invention also discloses a gate drive circuit including a plurality of shift registers and an output control part. The shift registers include plural stages that are connected one after another to each other to output a plurality of gate signals. The output control part blocks an output of the shift registers during a vertical blanking interval to apply a gate off voltage to the gate lines.

The present invention also discloses a display apparatus including a display panel, a source drive circuit, and a gate drive circuit. The display panel includes a plurality of gate lines, a plurality of data lines, and a plurality of pixel parts that are connected to the gate lines and the data lines. The source drive circuit provides the data lines with a data voltage. The gate drive circuit includes a plurality of shift registers and an output control part. The shift registers include plural stages that are connected one after another to each other to output a plurality of gate signals. The output control part blocks an output of the shift register during a vertical blanking interval to apply a gate off voltage to the gate lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
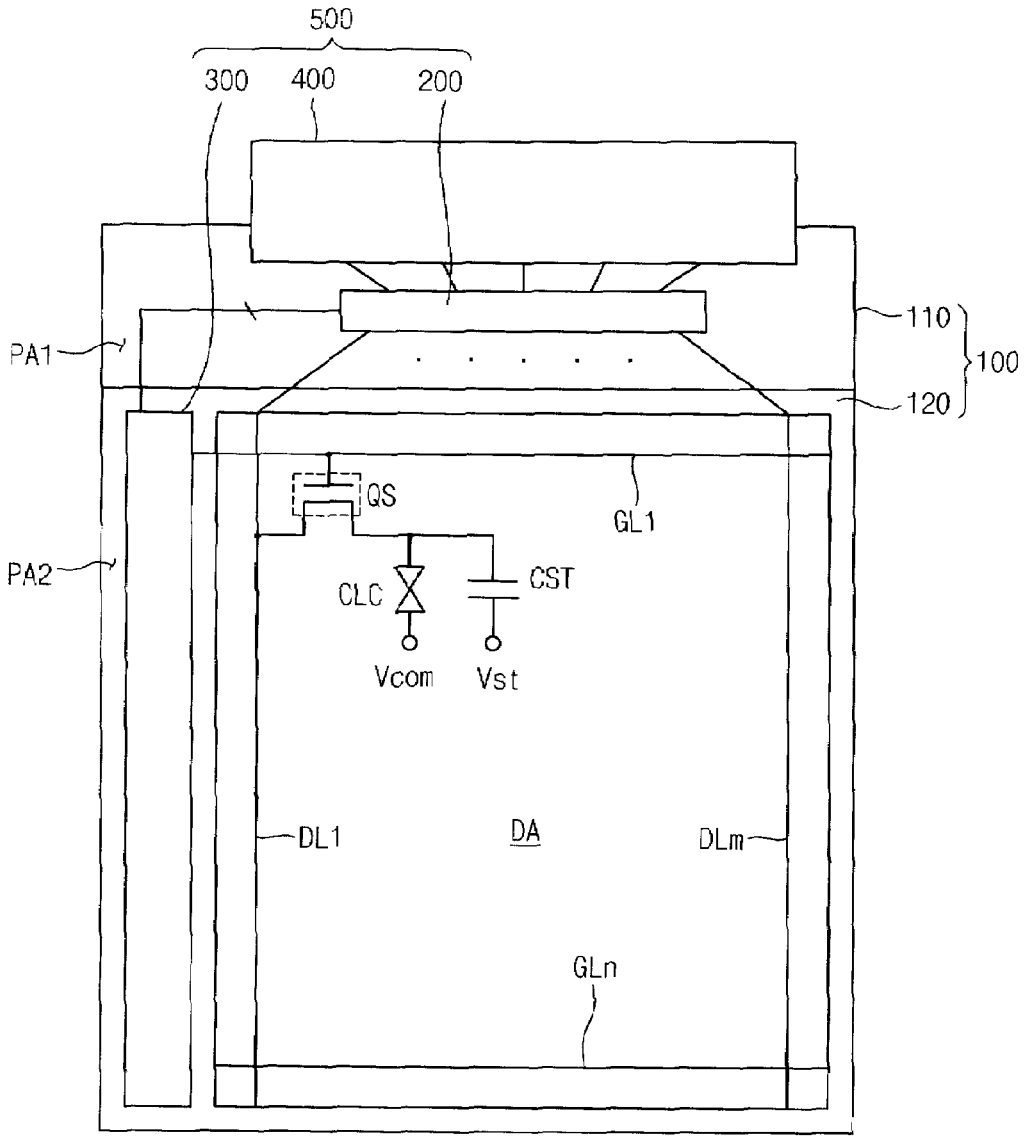
FIG. 1 is a plan view showing a display apparatus according to an exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be explained in detail with reference to the accompanying drawings.

FIG. 1 is a plan view showing a display apparatus according to an exemplary embodiment of the present invention.

Referring to FIG. 1, a display apparatus according to an exemplary embodiment of the present invention includes a display panel 100 and a drive circuit part 500 for driving the display panel 100.

The display panel 100 includes a display substrate 110, an opposite substrate 120 opposite to the display substrate 110, and a liquid crystal layer (not shown) interposed between the display substrate 110 and the opposite substrate 120. The display panel 100 may include a display area DA, on which an image is displayed, and a peripheral area PA surrounding the display area DA.

The display panel 100 also includes a plurality of gate lines GL1 to GLn and a plurality of data lines DL1 to DLm (wherein 'n' and 'm' are natural numbers) that cross the gate lines GL1 to GLn. A plurality of pixel parts may be defined by the gate lines GL1 to GLn and the data lines DL1 to DLm. Each pixel part includes a switching element QS, a liquid crystal capacitor CLC, and a storage capacitor CST. The switching element QS may include a thin-film transistor.

The drive circuit part 500 is formed in the peripheral area PA. The peripheral area PA includes a first peripheral area PA1 and a second peripheral area PA2. The drive circuit part 500 includes a driving part 200, a gate drive circuit 300, and a printed circuit board (PCB) 400.

The driving part 200 is in a unit chip to be mounted in the first peripheral area PA1. The driving part 200 provides the gate drive circuit 300 and the data lines DL1 to DLm with a gate control signal and a data voltage, respectively.

The gate drive circuit 300 is integrated in the second peripheral area PA2 as an amorphous silicon gate (ASG) type. The gate drive circuit 300 sequentially outputs a gate signal for activating the gate lines GL1 to GLn based on the gate control signal provided from the driving part 200.

The PCB 400 is attached in the first peripheral area PA1, and is electrically connected to an external device and the driving part 200 to transmit a data signal and a control signal provided from the external device to the driving part 200. The PCB 400 may be a flexible PCB (FPCB).

Figure 2:
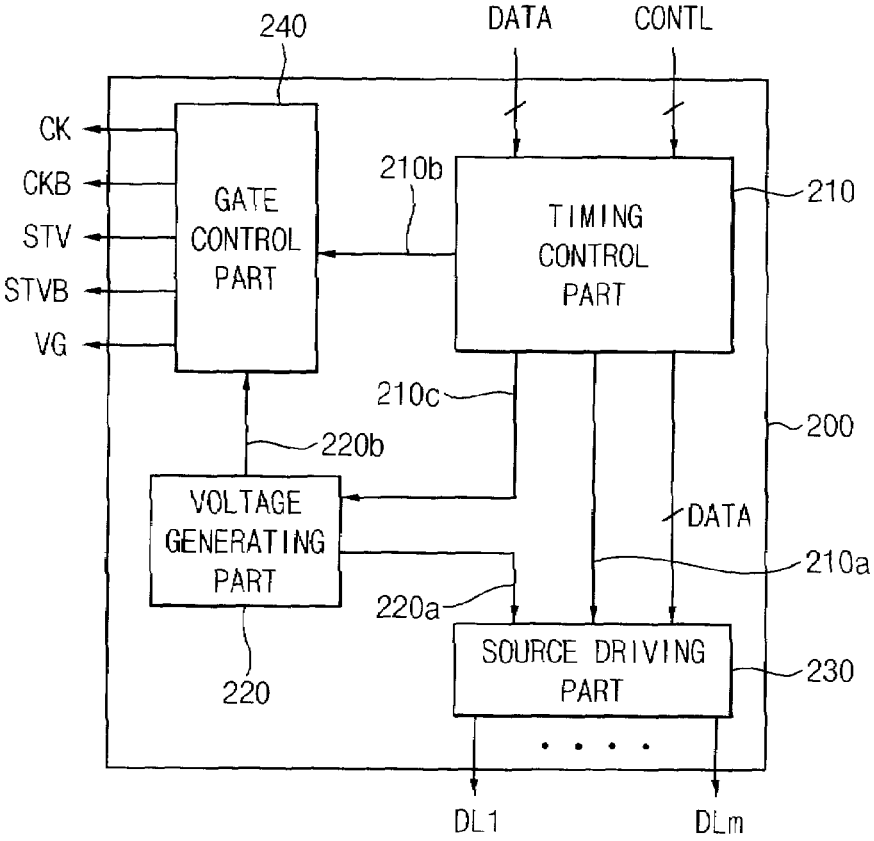
FIG. 2 is a block diagram showing a driving part of FIG. 1.

FIG. 2 is a block diagram illustrating a driving part of FIG. 1.

Referring to FIG. 1 and FIG. 2, the driving part 200 includes a timing control part 210, a voltage generating part 220, a source driving part 230, and a gate control part 240.

The timing control part 210 receives a data signal DATA and a control signal CONTL from the external device (not shown). The control signal CONTL includes a vertical synchronizing signal Vsync, a horizontal synchronizing signal Hsync, a main clock signal MCLK, a data enable signal DE, etc.

The timing control part 210 generates a source control signal 210*a* and a gate control signal 210*b* based on the control signal CONTL. The timing control part 210 provides the source driving part 230 with the source control signal 210*a*, and provides the gate control part 240 with the gate control signal 210*b*. The source control signal 210*a* includes a horizontal start signal STH, a data shift clock CPV, an inversion signal POL, etc. The gate control signal 210*b* includes a first vertical start signal STV, a second vertical start signal STVB, a first clock signal CK, a second clock signal CKB, etc. The timing control part 210 outputs a power control signal 210*c* to the voltage generating part 220.

The voltage generating part 220 generates various driving voltages for driving the display panel 100 in response to the power control signal 210*c* from the timing control part 210. The driving voltages include a gamma reference voltage 220*a*, a gate voltage 220*b*, a common voltage (not shown), etc. The gamma reference voltage 220*a* is provided to the source driving part 230, the gate voltage 220*b* is provided to the gate control part 240, and the common voltage is provided to the display panel 100.

The source driving part 230 converts the data signal DATA into an analog data voltage to output the analog data voltage to the data lines DL1 to DLm in response to the source control signal 210*a* from the timing control part 210.

The gate control part 240 outputs the gate control signal 210*b* from the timing control part 210 and the gate voltage VG from the voltage generating part 220 to the gate drive circuit 300. The gate voltage VG includes a first voltage VGH and a second voltage VGL. The first voltage VGH may be a gate on voltage VON, and the second voltage VGL may be a gate off voltage VOFF. The gate control part 240 converts the first and second clock signals CK and CKB, and the first and second vertical start signals STV and STVB that are provided from the timing control part 210 into the gate voltage VG level to output the converted gate voltage VG level to the gate drive circuit 300. The first clock signal CK has a phase opposite to the second clock signal CKB. The second vertical start signal STVB is delayed by a predetermined time with respect to the first vertical start signal STV.

The gate drive circuit 300 sequentially outputs a gate signal for driving the gate lines GL1 to GLn in response to the first and second clock signals CK and CKB and the first and second vertical start signals STV and STVB provided from gate control part 240 and the gate voltage VG provided from the voltage generating part 220.

Figure 3:
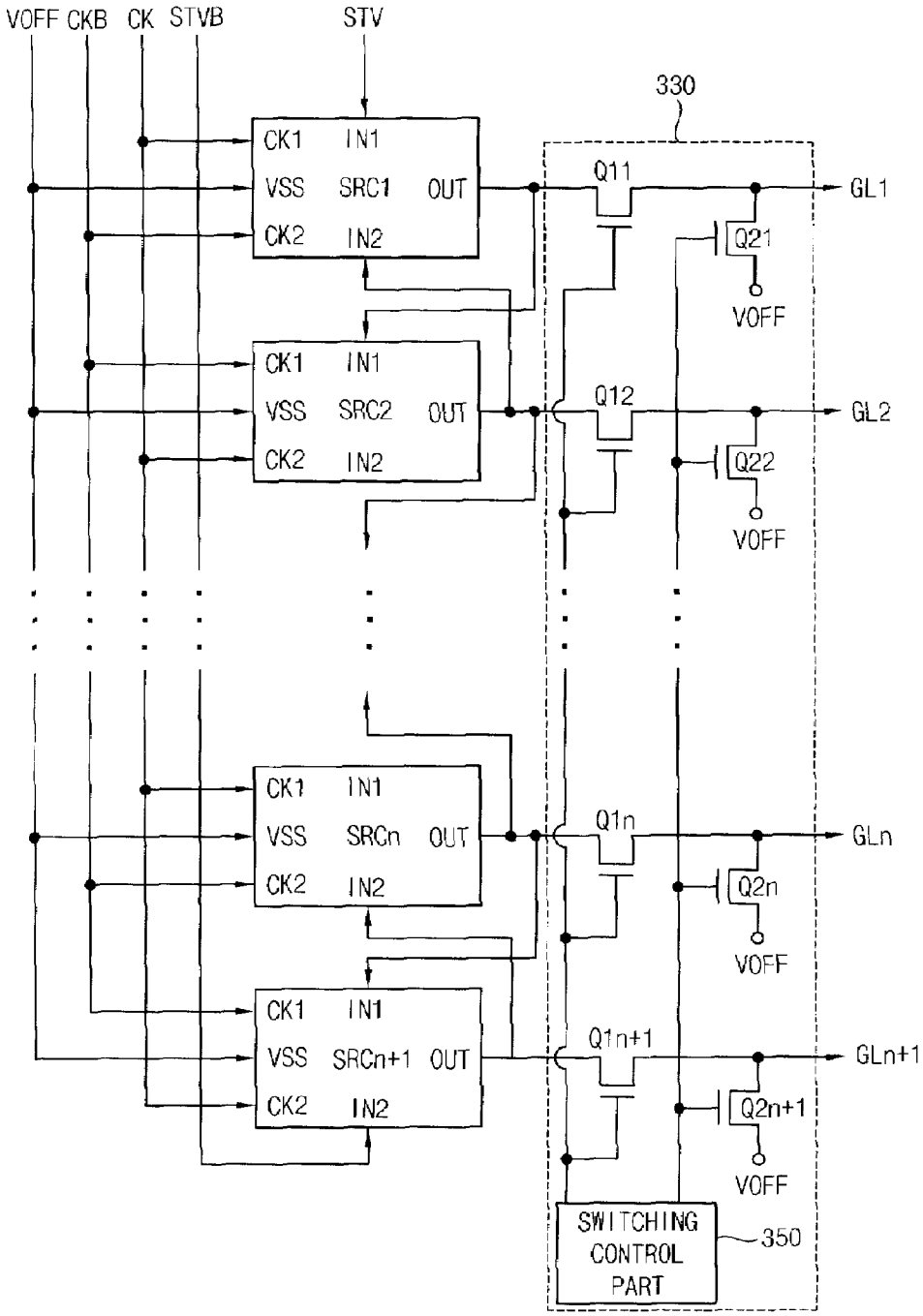
FIG. 3 is a block diagram showing a gate drive circuit of FIG. 1.

FIG. 3 is a block diagram illustrating a gate drive circuit of FIG. 1.

Referring to FIG. 1, FIG. 2, and FIG. 3, the gate drive circuit 300 includes n shift registers SRC1 to SRCn corresponding to the gate lines GL1 to GLn and a dummy shift register SRCn+1 (wherein 'n' is a natural number). The shift registers SRC1 to SRCn+1 are connected one after another to each other.

Each shift register includes a first input terminal IN1, a second input terminal IN2, a first clock terminal CK1, a second clock terminal CK2, a ground voltage terminal VSS, and an output terminal OUT. The first input terminal IN1 receives an output signal of a previous shift register, and the second input terminal IN2 receives an output signal of a following shift register. Here, the first vertical start signal STV is applied to the first input terminal IN1 of the first shift register SRC1. The second vertical start signal STVB is applied to the second input terminal IN2 of the dummy shift register SRCn+1. For odd numbered shift registers, the first clock signal CK is applied to the first clock terminal CK1, and the second clock signal CKB is applied to the second clock terminal CK2. For even numbered shift registers, the second clock signal CKB is applied to the first clock terminal CK1, and the first clock signal CK is applied to the second clock terminal CK2. The ground voltage VSS or the gate off voltage VOFF is applied to the ground voltage terminal VSS. Odd numbered shift registers output a gate signal in response to the first clock signal CK inputted to the first clock terminal CK1, and even numbered shift registers output a gate signal in response to the second clock signal CKB inputted to the first clock terminal CK1.

The gate drive circuit 300 further includes an output control part 330 for controlling an output of the shift registers SRC1 to SRCn+1. The output control part 330 includes a plurality of first switching elements Q11 to Q1*n*+1, a plurality of second switching elements Q21 to Q2*n*+1, and a switching control part 350.

The first switching elements Q11 to Q1*n*+1 include input electrodes respectively connected to an output terminal of the shift registers SRC1 to SRCn+1, control electrodes connected to a first output terminal of the switching control part 350, and output electrodes respectively connected to the gate lines GL1 to GLn.

The second switching elements Q21 to Q2*n*+1 include input electrodes connected to the ground voltage terminal VOFF, control electrodes connected to the second output terminal of the switching control part 350, and output electrodes respectively connected to the gate lines GL1 to GLn.

The switching control part 350 turns on the first switching elements Q11 to Q1*n*+1 and turns off the second switching elements Q21 to Q2*n*+1 during a data signal input interval. Thus, during the data signal input interval, output signals of the shift registers SRC1 to SRCn+1 are applied to the gate lines GL1 to GLn.

On the other hand, during a vertical blanking interval in which the data signal is not inputted, the switching control part 350 blocks an output of the shift registers SRC1 to SRCn+1, and applies a gate off voltage VOFF to the gate lines GL1 to GLn. During the vertical blanking interval, the switching control part 350 turns off the first switching elements Q11 to Q1*n*+1, and turns on the second switching elements Q21 to Q2*n*+1.

The vertical blanking interval is defined by the second vertical start signal STVB applied to a last shift register SRCn+1, and the first vertical start signal STV received after the second vertical start signal STVB to be applied to first shift register SRC1.

Moreover, the vertical blanking interval is defined by an output signal of the last shift register SRCn+1, which is applied to the last gate line GLn+1, and an output signal outputted after an output signal of the last shift register SRCn+1 to be applied to the first gate line GL1.

In the present exemplary embodiment, the output control part 330 is included in the gate drive circuit 300, however, it may have different structures. For example, the first switching elements Q11 to Q1*n*+1 and the second switching elements Q21 to Q2*n*+1 may be included in the gate drive circuit 300, and the switching control part 350 may be separated from the gate drive circuit 300 to be mounted on the PCB 400. Moreover, the switching control part 350 may be included in the driving part 200.

Figure 4:
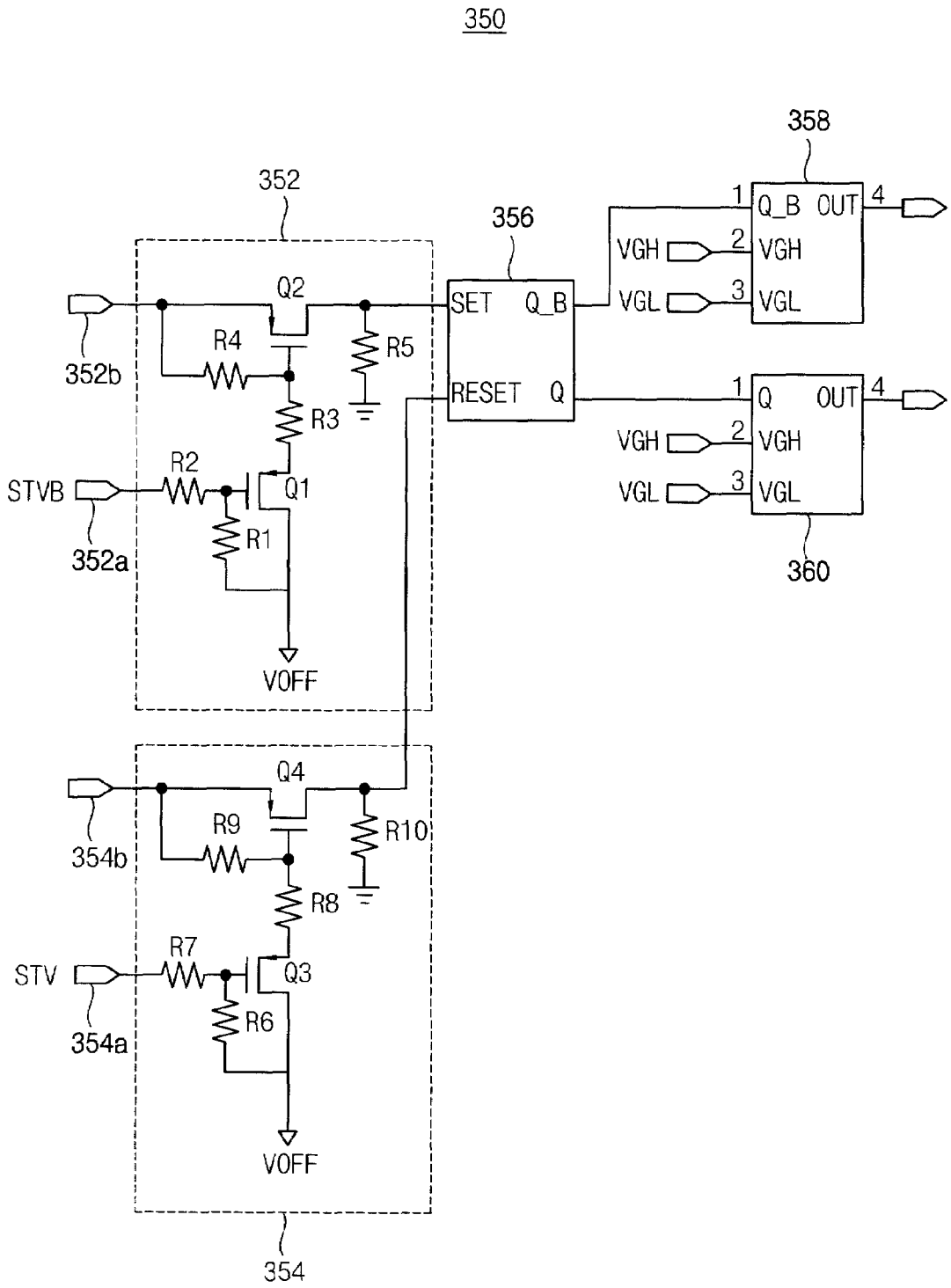
FIG. 4 is a block diagram showing a switching control part according to an exemplary embodiment of the present invention.

FIG. 4 is a block diagram showing a switching control part according to an exemplary embodiment of the present invention.

Referring to FIG. 4, the switching control part 350 includes a first level changing part 352, a second level changing part 354, a set-reset (SR) latch part 356, a third level changing part 358, and a fourth level changing part 360.

The first level changing part 352 outputs a logical high signal or a logical low signal in response to a level of the second vertical start signal STVB. The first level changing part 352 is connected to a set terminal part of the SR latch part 356.

The first level changing part 352 includes a first transistor Q1, a second transistor Q2, a pull down resistor R5, and resistors R1, R2, R3, and R4. The first transistor Q1 includes an input electrode connected to a ground voltage terminal VOFF, a control electrode connected to a first signal input terminal 352*a* to receive the second vertical start signal STVB, and an output electrode connected to a control electrode of the second transistor Q2. The second transistor Q2 includes an input electrode connected to a second signal input terminal 352*b* to receive a logical high signal, a control electrode connected to the output electrode of the first transistor Q1, and an output electrode connected to the set terminal of the SR latch part 356.

The first level changing part 352 outputs the logical high signal (i.e., about 3.3V) to the set terminal of the SR latch part 356 in response to a high level of the second vertical start signal STVB. That is, the first and second transistors Q1 and Q2 are turned on in response to a high level of the second vertical start signal STVB, and then the first and second transistors Q1 and Q2 receive the logical high signal, which is then applied to the set terminal of the SR latch part 356, through the second signal input terminal 352*b*. Alternatively, the first level changing part 352 outputs the logical low signal to the set terminal of the SR latch part 356 in response to a low value of the second vertical start signal STVB. For example, the first and second transistors Q1 and Q2 are turned on in response to a low value of the second vertical start signal STVB, and a logical high signal applied through the second signal input terminal 352*b* is pulled-down to a logical low signal by the pull-down resistor R5. Thus, the logical low signal is outputted to the set terminal of the SR latch part 356.

The second level changing part 354 outputs the logical high signal or the logical low signal to the reset terminal of the SR latch part 356 in response to a level of the first vertical start signal STV. The second level changing part 354 is connected to the reset terminal of the SR latch part 356. The second level changing part 354 includes a first transistor Q3, a second transistor Q4, a pull-down resistor R10, and resistors R6, R7, R8, and R9. The first transistor Q3 includes an input electrode connected to a ground voltage terminal VOFF, a control electrode connected to a third signal input terminal 354*a* to receive the first vertical start signal STV, and an output electrode connected to a control electrode of the second transistor Q4. The second transistor Q4 includes an input electrode connected to a fourth signal input terminal 354*b* to receive a logical high signal, a control electrode connected to the output electrode of the first transistor Q3, and an output electrode connected to the reset terminal of the SR latch part 356. An operation of the second level changing part 354 is similar as that of the first level changing part 352. Thus, any further explanation concerning the operation of the second level changing part 354 will be omitted.

The SR latch part 356 receives an output signal of the first level changing part 352 through its set terminal, and receives an output signal of the second level changing part 354 through its reset terminal. A first output terminal Q_B of the SR latch part 356 is connected to an input terminal of the third level changing part 358, and a second output terminal Q of the SR latch part 356 is connected to an input terminal of the fourth level changing part 360. An output signal of the first output terminal Q_B has a substantially inverted phase with an output signal of the second output terminal Q.

When the logic high signal is inputted to the set terminal, the first output terminal Q_B outputs the logic low signal, and the second output terminal Q outputs the logic high signal. When the logic high signal is inputted to the reset terminal, the first output terminal Q_B outputs the logic high signal, and the second output terminal Q outputs the logic low signal. When the logic high signal is inputted to the set terminal of the SR latch part 356, the SR latch part 356 latches an output of the first level changing part 352 until the logic high signal is inputted to the reset terminal.

The third level changing part 358 includes a first input terminal connected to the first output terminal Q_B of the SR latch part 356, a second input terminal receiving the first voltage VGH, a third input terminal receiving the second voltage VGL, and an output terminal connected to a control electrode of the first switching elements Q11 to Q1*n*+1. The third level changing part 358 outputs the first voltage VGH or the second voltage VGL in response to an output signal of the first output terminal Q_B. For example, the third level changing part 358 outputs the first voltage VGH in response to a logic high signal of the first output terminal OUT, and outputs the second voltage VGL in response to a logic low signal of the first output terminal Q_B.

The fourth level changing part 360 includes a first input terminal connected to the second output terminal Q of the SR latch part 356, a second input terminal receiving the first voltage VGH, a third input terminal receiving the second voltage VGL, and an output terminal connected to a control electrode of the second switching elements Q21 to Q2*n*+1. The fourth level changing part 360 outputs the first voltage VGH or the second voltage VGL in response to an output signal of the second output terminal Q of the SR latch part 356. For example, the fourth level changing part 360 outputs the first voltage VGH in response to a logic high signal of the second output terminal Q, and outputs the second voltage VGL in response to a logic low signal of the second output terminal Q.

Figure 5:
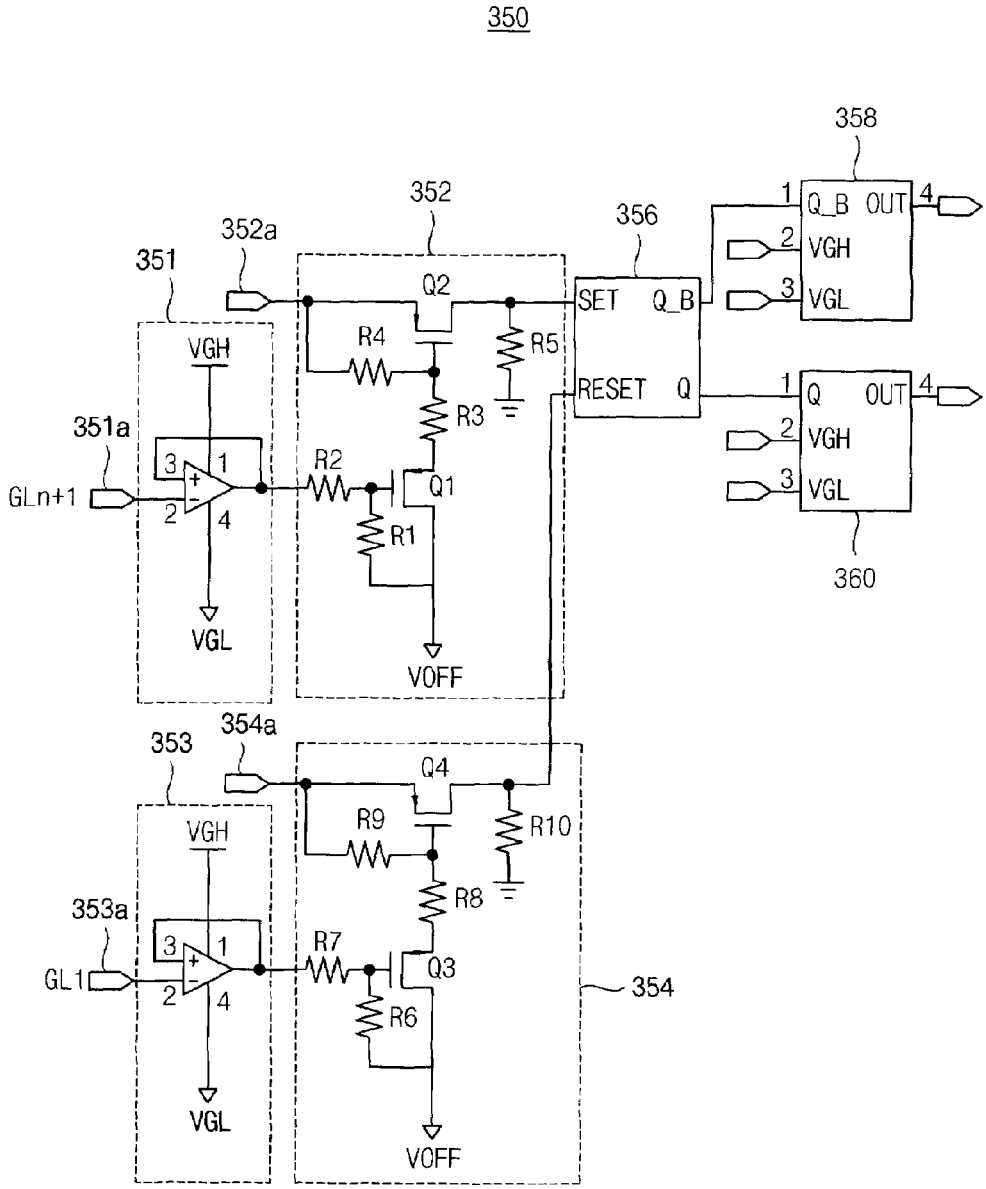
FIG. 5 is a block diagram showing a switching control part according to another exemplary embodiment of the present invention.

FIG. 5 is a block diagram showing a switching control part according to another exemplary embodiment of the present invention.

The switching control part of FIG. 5 is substantially the same as the switching control part of FIG. 4 except that a first buffer 351 and a second buffer 353 are added as an output signal of a first shift register and an output signal of a last shift register are inputted to the switching control part. Thus, the same reference numerals will be used to refer to the same or like parts as those described in FIG. 4 and any further explanation concerning the above elements will be omitted.

Referring to FIG. 1, FIG. 3 and FIG. 5, the switching control part 350 includes a first buffer 351, a first level changing part 352, a second buffer 353, a second level changing part 354, a SR latch part 356, a third level changing part 358, and a fourth level changing part 360.

The buffer 351 buffers an output signal of the last shift register SCn+1, which is received from a signal input terminal 351*a*, and outputs the buffered output signal of the last shift register SCn+1. The output signal of the first buffer 351 has a value between the first voltage VGH and the second voltage VGL. For example, the first buffer 351 may output the first voltage VGH in response to a high level of the second vertical start signal STVB, and may output the second voltage VGL in response to a low level of the second vertical start signal STVB.

The first level changing part 352 outputs a logic high signal or a logic low signal to the set terminal of the SR latch part 356 in response to an output level of the first buffer 351. The first level changing part 352 is connected to a set terminal part of the SR latch part 356.

The second buffer 353 buffers an output signal of the first shift register SRC1, which is received from a signal input terminal 353*a*, and outputs the buffered output signal of the first shift register SRC1.

The second level changing part 354 outputs the logic high signal or the logic low signal to the reset terminal of the SR latch part 356 in response to an output level of the second buffer 353.

The SR latch part 356 receives an output of the first level changing part 352 through its set terminal, and receives an output of the second level changing part 354 through its reset terminal. A first terminal Q_B of the SR latch part 356 is connected to an input terminal of the third level changing part 358, and a second output terminal Q is connected to an input terminal of the fourth level changing part 360.

Figure 6:
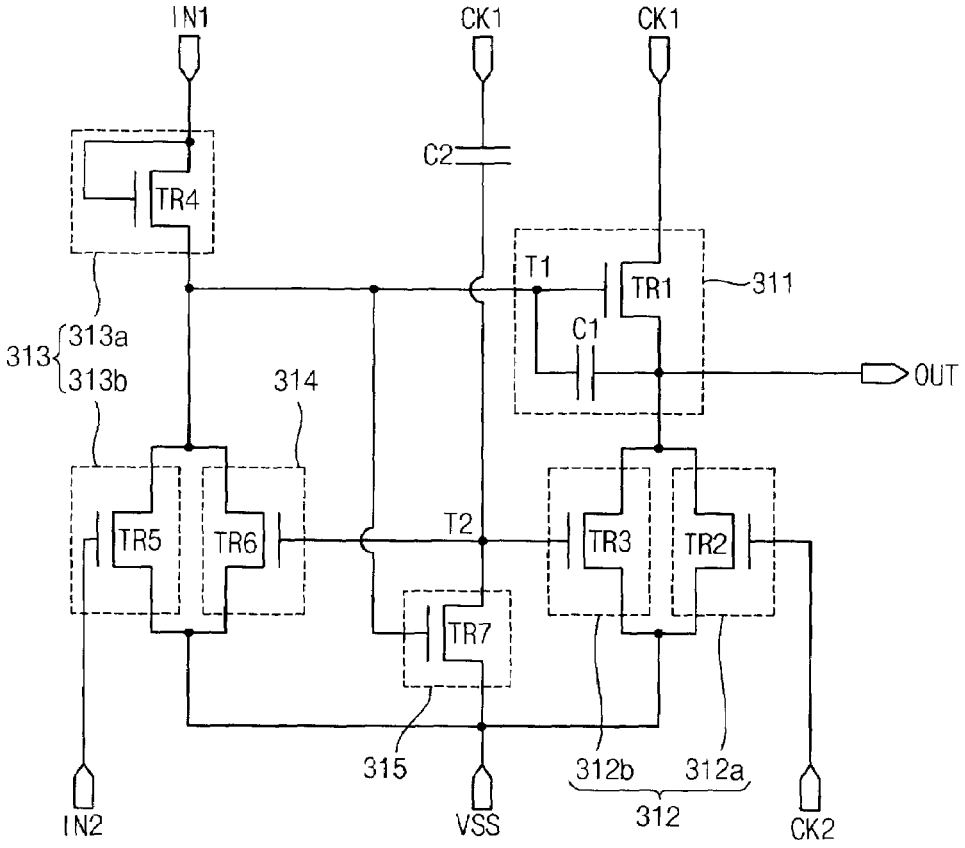
FIG. 6 is a circuit diagram showing a shift register of FIG. 2.

FIG. 6 is a circuit diagram showing a shift register of FIG. 2.

Referring to FIG. 2 and FIG. 6, the shift register includes a pull-up part 311, a pull-down part 312, a pull-up driving part 313, a ripple preventing part 314, and a pull-down control part 315.

The pull-up part 311 outputs a first clock signal CK received through a first clock terminal CK1 to an output terminal OUT, and pulls up a gate signal. The pull-up part 311 includes a first transistor TR1 and a charging capacitor C1. The first transistor TR1 includes an input electrode connected to the first clock terminal CK1 and an output electrode connected to the output terminal OUT. The charging capacitor C1 is formed between a control electrode and the output electrode of the first transistor TR1. The charging capacitor C1 stores a high value of an output signal (or a first vertical start signal STV) of a previous shift register that is provided to a first input terminal IN1 to be applied to a control electrode of the first transistor TR1, and turns on the first transistor TR1.

The pull-down part 312 includes a first pull-down part 312*a* and a second pull-down part 312*b*. The first pull-down part 312*a* pulls down the gate signal outputted to the output terminal OUT to a gate off voltage VOFF in response to a second clock signal CKB received from a second clock terminal CK2. The first pull-down part 312*a* includes a second transistor TR2. The second transistor TR2 includes an input electrode connected to a ground voltage terminal VSS, a control electrode connected to the second clock terminal CK2, and an output electrode connected to the output terminal OUT.

The second pull-down part 312*b* pulls down the gate signal outputted to the output terminal OUT to a gate off voltage VOFF in response to the first clock signal CK. The second pull-down part 312*b* includes a third transistor TR3. The third transistor TR3 includes an input electrode connected to the ground voltage terminal VSS, a control electrode connected to a switching capacitor C2, and an output electrode connected to the output terminal OUT.

The pull-up driving part 313 turns on the pull-up part 311 in response to a high value of an output signal of a previous shift register, which is received from the first input terminal IN1, and turns off the pull-up part 311 in response to a high value of an output signal of the following shift register, which is received from a second input terminal IN2.

The pull-up driving part 313 includes a first pull-up driving part 313*a* and a second pull-up driving part 313*b*. The first pull-up driving part 313*a* includes a fourth transistor TR4. The fourth transistor TR4 includes an input electrode and a control electrode, which are commonly connected to the first input terminal IN1, and an output electrode connected to the control electrode of the first transistor TR1 to define a first node T1. Here, the control electrode of the first transistor TR1 may be defined as a control electrode which switches on/off of the pull-up part 311.

The second pull-up driving part 313*b* includes a fifth transistor TR5. The fifth transistor TR5 includes an input electrode connected to the ground voltage terminal VSS, an output electrode connected to the control electrode of the first transistor TR1 to define the first node T1, and a control electrode connected to the second input terminal IN2.

In the pull-up driving part 313, when the fourth transistor TR4 is turned on in response to a high value of an output signal of a previous shift register, the high value of the output signal of the previous shift register is applied to the first node T1 to be charged in the charging capacitor C1. Charges of more than a threshold voltage of the first transistor TR1 are charged in the charging capacitor C1 and the first clock signal CK of low value is changed into high value, so that the second switching element TR2 is bootstrapped and high value of the first clock signal CK is outputted to the output terminal OUT.

Then, when the fifth transistor TR5 is turned on in response to high value of an output signal of a following shift register, the charge that is charged in the charging capacitor C1 is discharged in a level of the gate off voltage VOFF of the ground voltage terminal VSS. The first node T1 is changed in a low value due to discharging of the charging capacitor C1, and the first transistor TR1 is turned off, so that outputting of the first clock signal CK1 is stopped.

When the first transistor TR1 is turned off and the second transistor TR2 is turned on, the gate signal outputted through the output terminal OUT is changed into the gate off voltage VOFF. Moreover, the third transistor TR3 is turned on in response to high level of the first clock signal CK charged in the charging capacitor C2, and a signal outputted through the output terminal OUT continuously maintains a low value. That is, the second transistor T2 and the third transistor TR3 are alternately turned on to pull down a gate signal outputted through the output terminal OUT into a low value.

The ripple preventing part 314 maintains a level of the first node T1 at the gate off voltage VOFF to prevent a generation of a ripple of the first node T1 from being generated by a coupling of the first clock signal CK. The ripple preventing part 314 includes a sixth transistor TR6. The sixth transistor TR6 includes an input electrode connected to the ground voltage terminal VSS, a control electrode connected to the switching capacitor C2, and an output electrode connected to the first node T1. The ripple preventing part 314 maintains a level of the first node T1 at a low value to turn off the pull-up part 311 after the gate signal is changed into a low value by the pull-down part 312, and prevents a ripple from being generated at the first node T1 due to a coupling of the first clock signal CK.

The pull-down control part 315 turns off the ripple preventing part 314 in response to a signal of the first node T1. The pull-down control part 315 includes a seventh transistor TR7. The seventh transistor TR7 includes an input electrode connected to the ground voltage terminal VSS, an output electrode connected to a second node T2, and a control electrode connected to the first node T1. In the pull-down control part 315, when a high value of the first clock signal CK is applied through the switching capacitor C2 and a level of the first node T1 is a high level, the seventh transistor TR7 is turned off, so that a level of the second node T2 is a high value. Thus, even though the first clock signal CK is a high value during a turn-on operation interval of the pull-up part 311, the ripple preventing part 314 is turned off.

A first terminal of the switching capacitor C2 is connected to the first clock terminal CK1, a second terminal of the switching capacitor C2 is connected to control electrodes of the third and sixth transistors TR3 and TR6 and an output electrode of the seventh transistor TR7, so that the second node T2 is defined. The switching capacitor C2 charges the first clock signal CK, and applies the stored first clock signal CK to the second node T2 to turn the third and sixth transistors TR3 and TR6 on and off.

Figure 7:
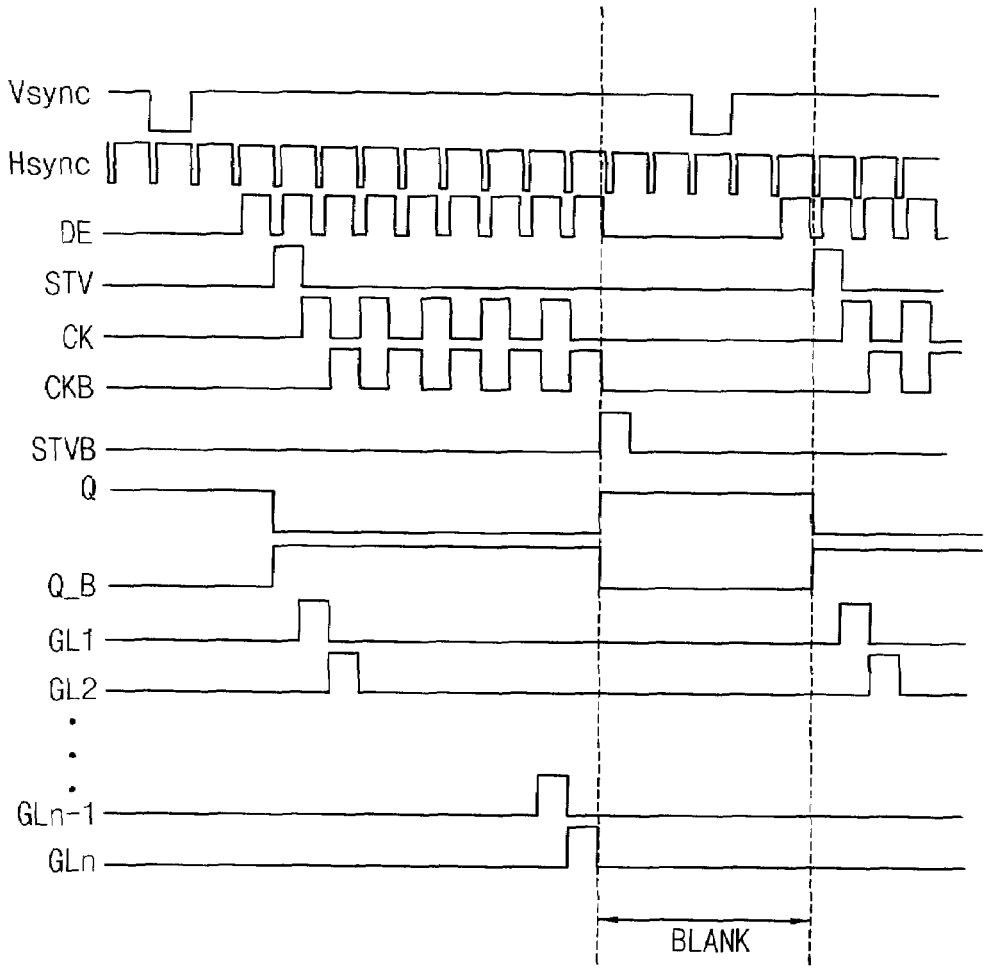
FIG. 7 is a timing diagram showing an operation of a gate drive circuit of FIG. 3.

FIG. 7 is a timing diagram showing an operation of a gate drive circuit of FIG. 3.

Referring to FIG. 1, FIG. 3 and FIG. 7, the gate drive circuit 300 sequentially outputs a gate signal driving the gate lines GL1 to GLn in response to a high level of the first vertical start signal STV received from the gate control part 240. The vertical blanking interval BLANK is defined by the second vertical start signal STVB applied to last shift register SRCn+

1, and the first vertical start signal STV received after the second vertical start signal STVB to be applied to a first shift register SRC1.

When a logic high signal is applied to the reset terminal of the SR latch part 356 in response to a high level of the first vertical start signal STV, the first output terminal Q_B of the SR latch part 356 outputs a logic high signal, and the second output terminal Q of the SR latch part 356 outputs a logic low signal. Thus, the first switching elements Q11 to Q1*n*+1 are turned on and the second switching elements Q21 to Q2*n*+1 are turned off, so that the gate signals are applied to the gate lines GL1 to GLn.

After a predetermined time, a logic high signal is applied to the set terminal of the SR latch part 356 in response to a high level of the second vertical start signal STVB applied after outputting of a gate signal corresponding to the last gate line GLn. An output signal of the first output terminal Q_B of the SR latch part 356 is changed into a logic low signal, and an output signal of the second output terminal Q is changed into a logic high signal. Thus, the first switching elements Q11 to Q1*n*+1 are turned off and the second switching elements Q21 to Q2*n*+1 are turned on, so that the gate off voltage VOFF is applied to the gate lines GL1 to GLn. An output of the SR latch part 356 maintains the vertical blanking interval BLANK, that is, until a high level of the first vertical start signal STV received after the second start signal STV is received. According to the present exemplary embodiment, during the vertical blanking interval BLANK, an output signal of the gate drive circuit 300 may be maintained at a gate off voltage VOFF.

As described above, according to exemplary embodiments of the present invention, an output signal of the gate drive circuit may maintain a gate off voltage during a vertical blanking interval in which a clock signal is not applied to a gate drive circuit, so that a clock signal is not applied to the gate drive circuit so that an output of the gate drive circuit is prevented from being floated. Therefore, driving defects of a display apparatus may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A gate drive circuit, comprising:

a plurality of shift registers, in which plural stages are connected one after another to each other, configured to output a plurality of gate signals; and an output control part configured to block outputs of the shift registers during a vertical blanking interval, the output control part configured to apply a gate off voltage to all of the gate lines, wherein the plurality of shift registers are configured to generate the plurality of gate signals using at least one clock signal, and during the vertical blanking interval, the at least one clock signal is not supplied to the plurality of shift registers, wherein data signals are not applied to data lines during the vertical blanking interval, wherein the output control part comprises:

a first switching element connected to an output terminal of each of the shift registers, respectively;

a second switching element connected to an output terminal of the first switching element and the gate lines, respectively; and a switching control part configured to turn off the first switching elements and turn on the second switching elements during the vertical blanking interval, the second switching element being configured to apply the gate off voltage to the gate line, and wherein the switching control part comprises an SR latch part comprising a set terminal configured to receive a second vertical start signal applied to a last shift register of the shift registers and a reset terminal configured to receive a first vertical start signal applied to a first shift register of the shift registers to be applied after the second vertical start signal, and the SR latch part is configured to output an output signal turning off the first switching element and turn on the second switching element in response to a high level of the second vertical start signal.

2. The gate drive circuit of claim 1, wherein the switching control part further comprises:

a first level changing part configured to output a high signal to the set terminal of the SR latch part in response to the high level of the second vertical start signal;

a second level changing part configured to output a high signal to the reset terminal of the SR latch part in response to a high level of the first vertical start signal;

a third level changing part configured to output a first voltage for turning off the first switching element in response to a low signal received from a first output terminal of the SR latch part during the vertical blanking interval; and a fourth level changing part configured to output a second voltage for turning on the second switching element in response to a high signal received from a second output terminal of the SR latch part during the vertical blanking interval.

3. A gate drive circuit, comprising:

a plurality of shift registers, in which plural stages are connected one after another to each other, configured to output a plurality of gate signals; and an output control part configured to block outputs of the shift registers during a vertical blanking interval, the output control part configured to apply gate off voltages to all of the gate lines, wherein the plurality of shift registers are configured to generate the plurality of gate signals using at least one clock signal, and during the vertical blanking interval, the at least one clock signal is not supplied to the plurality of shift registers, wherein data signals are not applied to data lines during the vertical blanking interval, wherein the output control part comprises:

a first switching element connected to an output terminal of each of the shift registers, respectively;

a second switching element connected to an output terminal of the first switching element and the gate lines, respectively; and a switching control part configured to turn off the first switching elements and turn on the second switching elements during the vertical blanking interval, the second switching element being configured to apply the gate off voltage to the gate line, and wherein the switching control part comprises an SR latch part comprising a set terminal configured to receive an output signal outputted from a last shift register of the shift registers and a reset terminal configured to receive an output signal outputted from a first shift register of the shift registers which is outputted after the output signal of the last shift register, and the SR latch part is configured to turn off the first switching element and turn on the second switching element in response to a high level of the output signal of the last shift register.

4. The gate drive circuit of claim 3, wherein the switching control part further comprises:

a first level changing part configured to output a high signal to the set terminal of the SR latch part in response to the high level of the output signal of the last shift register;

a second level changing part configured to output a high signal to the reset terminal of the SR latch part in response to a high level of the output signal of the first shift register;

a third level changing part configured to output a first voltage for turning off the first switching element in response to a low signal received from a first output terminal of the SR latch part during the vertical blanking interval; and a fourth level changing part configured to output a second voltage for turning on the second switching element in response to a high signal received from a second output terminal of the SR latch part during the vertical blanking interval.

5. The gate drive circuit of claim 4, wherein the switching control part further comprises:

a first buffer configured to buffer the output signal of the last shift register; and a second buffer configured to buffer the output signal of the first shift register.

6. A display apparatus, comprising:

a display panel comprising a plurality of gate lines, a plurality of data lines, and a plurality of pixel parts that are connected to the gate lines and the data lines;

a source drive circuit configured to provide the data lines with a data voltage;

a gate drive circuit comprising a plurality of shift registers, in which plural stages are connected one after another to each other, configured to output a plurality of gate signals, and an output control part configured to block outputs of the shift registers during a vertical blanking interval, the output control part being configured to apply a gate off voltage to all of the gate lines; and a printed circuit board (PCB) electrically connected to the display panel, wherein the plurality of shift registers are configured to generate the plurality of gate signals using at least one clock signal, and during the vertical blanking interval, the at least one clock signal is not supplied to the plurality of shift registers, wherein data signals are not applied to the data lines during the vertical blanking interval, wherein the output control part comprises:

a first switching element connected to an output terminal of each of the shift registers, respectively;

a second switching element connected to an output terminal of the first switching element and the gate lines, respectively; and a switching control part configured to turn off the first switching elements and turn on the second switching elements during the vertical blanking interval, the second switching element being configured to apply the gate off voltage to the gate line, wherein the display panel comprises a display area having the pixel part formed therein and a peripheral area surrounding the display area, and the gate drive circuit is formed in the peripheral area, and wherein the shift registers and the first and second switching elements are formed in the peripheral area, and the switching control part is disposed on the PCB.

7. The display apparatus of claim 6, wherein the switching control part comprises an SR latch part comprising a set terminal configured to receive a second vertical start signal, which is the signal for the vertical blanking interval and is applied to a last shift register of the shift registers, and a reset terminal configured to receive a first vertical start signal applied to a first shift register of the shift registers to be applied after the second vertical start signal, and the SR latch part is configured to output an output signal turning off the first switching element and turn on the second switching element in response to a high level of the second vertical start signal.

8. The display apparatus of claim 7, wherein the switching control part further comprises:

a first level changing part configured to output a high signal to the set terminal of the SR latch part in response to the high level of the second vertical start signal;

a second level changing part configured to output a high signal to the reset terminal of the SR latch part in response to a high level of the first vertical start signal;

a third level changing part configured to output a first voltage for turning off the first switching element in response to a low signal received from a first output terminal of the SR latch part during the vertical blanking interval; and a fourth level changing part configured to output a second voltage for turning on the second switching element in response to a high signal received from a second output terminal of the SR latch part during the vertical blanking interval.

9. The display apparatus of claim 6, wherein the switching control part comprises an SR latch part comprising a set terminal configured to receive an output signal outputted from a last shift register of the shift registers and a reset terminal configured to receive an output signal outputted from a first shift register of the shift registers which is outputted after the output signal of the last shift register, and the SR latch part is configured to turn off the first switching element and turn on the second switching element in response to a high level of the output signal of the last shift register.

10. The display apparatus of claim 9, wherein the switching control part further comprises:

a first level changing part configured to output a high signal to the set terminal of the SR latch part in response to the high level of the output signal of the last shift register;

a second level changing part configured to output a high signal to the reset terminal of the SR latch part in response to a high level of the output signal of the first shift register;

a third level changing part configured to output a first voltage for turning off the first switching element in response to a low signal received from a first output terminal of the SR latch part during the vertical blanking interval; and a fourth level changing part configured to output a second voltage for turning on the second switching element in response to a high signal received from a second output terminal of the SR latch part during the vertical blanking interval.

11. The display apparatus of claim 10, wherein the switching control part further comprises:

a first buffer configured to buffer the output signal of the last shift register; and a second buffer configured to buffer the output signal of the first shift register.

* * * * *

UNITED STATES PATENT AND TRADEMARK OFFICE

CERTIFICATE OF CORRECTION

PATENT NO. : 8,552,958 B2
APPLICATION NO. : 12/557008
DATED : October 8, 2013
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 707 days.

Signed and Sealed this
Nineteenth Day of May, 2015

Michelle K. Lee

Michelle K. Lee
*Director of the United States Patent and Trademark Office*